US011162741B2

(12) United States Patent
Berthelot et al.

(10) Patent No.: US 11,162,741 B2
(45) **Date of Patent: *Nov. 2, 2021**

(54) HEAT EXCHANGER WITH LOUVERED FINS

(71) Applicant: LGL France, Maisons-Alfort (FR)

(72) Inventors: Pierre Berthelot, Beynost (FR); Remy Borg, Genas (FR); Alain Compingt, Grezieu la Varenne (FR); Kapil Sahu, Chennai (IN); Patrick Taurelle, Genas (FR)

(73) Assignee: LGL France, Maisons-Alfort (FR)

( * ) Notice: Subject to any disclaimer, the term of this patent is extended or adjusted under 35 U.S.C. 154(b) by 379 days.

This patent is subject to a terminal disclaimer.

(21) Appl. No.: 16/249,114

(22) Filed: Jan. 16, 2019

(65) Prior Publication Data

US 2019/0145715 A1 May 16, 2019

Related U.S. Application Data

(63) Continuation of application No. 15/007,249, filed on Jan. 27, 2016, now Pat. No. 10,209,012.

(60) Provisional application No. 62/119,904, filed on Feb. 24, 2015.

(51) Int. Cl.

| | |
|---|---|
| ***F28F 1/20*** | (2006.01) |
| ***F28F 1/30*** | (2006.01) |
| ***F28F 1/12*** | (2006.01) |
| ***F28F 1/32*** | (2006.01) |

(52) U.S. Cl.

CPC ..... *F28F 1/20* (2013.01); *F28F 1/128* (2013.01); *F28F 1/30* (2013.01); *F28F 1/32* (2013.01); *F28F 1/325* (2013.01)

(58) Field of Classification Search

CPC ..... F28F 1/10; F28F 1/12; F28F 1/128; F28F 1/20; F28F 1/30; F28F 1/32; F28F 1/325; F28F 2215/00; F28F 2215/04; F28F 2215/08

USPC ..... 165/151, 152

See application file for complete search history.

(56) References Cited

U.S. PATENT DOCUMENTS

| | | | | |
|---|---|---|---|---|
| 4,434,846 A | | 3/1984 | Lu | |
| 4,723,599 A | | 2/1988 | Hanson | |
| 4,923,002 A | | 5/1990 | Haussmann | |
| 5,289,874 A | | 3/1994 | Kadle et al. | |
| 5,311,935 A | | 5/1994 | Yamamoto et al. | |
| 5,360,060 A | | 11/1994 | Tanaka et al. | |
| 5,509,469 A | * | 4/1996 | Obosu | F28F 1/325 165/151 |
| 5,722,485 A | * | 3/1998 | Love | F28F 1/325 165/151 |

(Continued)

FOREIGN PATENT DOCUMENTS

| | | |
|---|---|---|
| EP | 2141434 A1 | 1/2010 |
| EP | 2708841 A1 | 3/2014 |

*Primary Examiner* — Len Tran
*Assistant Examiner* — Gustavo A Hincapie Serna
(74) *Attorney, Agent, or Firm* — Shackelford, Bowen, McKinley & Norton, LLP

(57) ABSTRACT

The present application provides a heat exchanger for exchanging heat between a first fluid and a second fluid. The heat exchanger may include a number of fin plates and a number of tubes extending though the fin plates with the first fluid therein. The fin plates may include a number of louvers extending between the tubes such that the second fluid flows through the louvers.

15 Claims, 2 Drawing Sheets

(56) References Cited

U.S. PATENT DOCUMENTS 5,752,567 A 5/1998 Obosu
5,934,363 A 8/1999 Jung et al.
5,975,199 A 11/1999 Park et al.
6,401,809 B1 * 6/2002 Zhang ..... F28F 1/128 165/146
6,513,587 B2 2/2003 All et al.
6,543,527 B1 * 4/2003 Bouzida ..... F28F 1/128 165/152
6,786,274 B2 * 9/2004 Bemisderfer ..... F28D 1/0477 165/151
6,976,529 B2 * 12/2005 Kester ..... F28F 1/325 165/151
7,380,403 B2 6/2008 Smah et al.
7,552,760 B1 6/2009 Ben Lakhdhar et al.
8,267,160 B2 * 9/2012 Hancock ..... F28F 1/325 165/151
8,973,647 B2 * 3/2015 Seo ..... F24F 1/0067 165/151
9,441,890 B2 * 9/2016 Kim ..... F28F 1/325
9,915,481 B2 * 3/2018 Nakamura ..... F28D 1/05383
10,209,012 B2 * 2/2019 Berthelot ..... F28F 1/32
10,415,894 B2 * 9/2019 Abrahamian ..... F28F 1/325
2002/0023744 A1 2/2002 Kim et al.
2003/0094267 A1 5/2003 Young
2003/0136554 A1 * 7/2003 Hu ..... F28F 1/128 165/151
2008/0190588 A1 * 8/2008 Heidenreich ..... F28D 1/047 165/151
2009/0308585 A1 * 12/2009 Chen ..... F28F 1/32 165/185
2013/0199760 A1 * 8/2013 Kadle ..... F28F 1/128 165/152
2014/0224462 A1 * 8/2014 Kamada ..... F25D 21/12 165/181
2016/0231066 A1 * 8/2016 Gopireddy ..... F28F 21/067

* cited by examiner

HEAT EXCHANGER WITH LOUVERED FINS

RELATED APPLICATIONS

This application is a continuation of U.S. patent application Ser. No. 15/007,249, filed on Jan. 27, 2016. U.S. patent application Ser. No. 15/007,249 is a non-provisional application claiming priority to U.S. Provisional Application No. 62/119,904, filed on Feb. 24, 2015. U.S. patent application Ser. No. 15/007,249 and U.S. Provisional Application No. 62/119,904 are incorporated herein by reference.

TECHNICAL FIELD

The present application and the resultant patent relate generally to fin and tube type heat exchangers and more particularly relate to a fin and tube type heat exchanger having louvered fins for increased capacity, higher heat transfer, and a reduced pressure drop.

BACKGROUND OF THE INVENTION

Fin and tube type heat exchanges are well known. Generally described, the fins may be in the form of a number of spaced apart parallel plates. The tubes pass through the fins and are attached thereto. A first hot or cold fluid such as a refrigerant flows through the tubes and exchanges heat with a second fluid such as air that flows between the fins.

Known fin and tube type heat exchangers have used fins in the form of a planar plate. Such a planar plate fin may have a low pressure drop but may have high air-side thermal resistance. Louvered fins also have been used. The louvered fins may have lower airside thermal resistance but may have a higher pressure drop and may be subject to fouling over time due to the geometry. Other types of fin configurations also may be known.

There is thus a desire for an improved fin and tube type heat exchanger for use with a cooler or other type of refrigerated device. Preferably such an improved fin and tube type heat exchanger may have increased capacity with greater heat transfer with less of a pressure drop therethrough.

SUMMARY OF THE INVENTION

The present application and the resultant patent thus proved a heat exchanger for exchanging heat between a first fluid and a second fluid. The heat exchanger may include a number of fin plates and a number of tubes extending though the fin plates with the first fluid therein. The fin plates may include a number of louvers extending between the tubes such that the second fluid flows through the louvers for heat exchange with the first fluid.

The present application and the resultant patent further provide a method of exchanging heat between a first fluid and a second fluid in a fin and tube heat exchanger. The method may include the steps of flowing the first fluid through a number of tubes, flowing the second fluid though a number of fin plates, forcing the second fluid though a number of louvers in the fin plates, eliminating airflow boundaries on the louvers with the flow of the second fluid, and exchanging heat between the first fluid and the second fluid.

The present application and the resultant patent further provide a heat exchanger for exchanging heat between a first fluid and a second fluid. The heat exchanger may include a number of aluminum fin plate columns and a number of tubes extending though the aluminum fin plate columns with the first fluid therein. The number of aluminum fin plate columns may include a number of louvers extending between the tubes such that the second fluid flows through the louvers for heat exchange with the first fluid.

These and other features and improvements of the present application and the resultant patent will become apparent to one of ordinary skill in the art upon review of the following detailed description when taken in conjunction with the several drawings and the appended claims.

DETAILED DESCRIPTION

Figure 1:
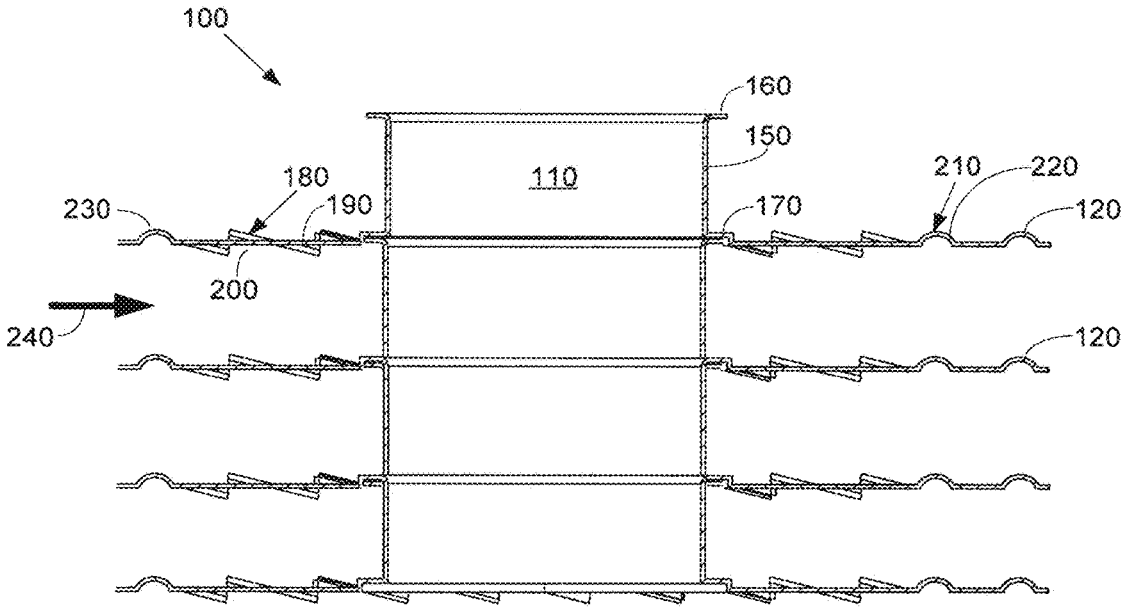
FIG. 1 is a side view of a louvered fin heat exchanger as may be described herein.

Referring now to the drawings, in which like numerals refer to like elements throughout the several views, FIGS. 1-5 show a portion of an example of a heat exchanger 100 as may be described herein. The heat exchanger 100 may be used in a cooler, a refrigerator, or any type of heating, ventilation, or air conditioning application. Likewise, the heat exchanger 100 may have domestic, retail, and/or industrial uses. The heat exchanger 100 may include a number of tubes 110. The tubes 110 may have any suitable size, shape, configuration, or capacity. Any number of the tubes 110 may be used herein. The tubes 110 may be made out of any suitable metal with good heat transfer characteristics. A first fluid such as a refrigerant may flow through the tubes 110.

Figure 3:
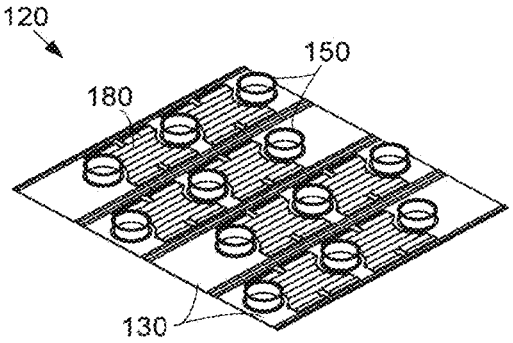
FIG. 3 is a top perspective view of a portion of the array of louvered fin plate columns of FIG. 2.
Figure 4:
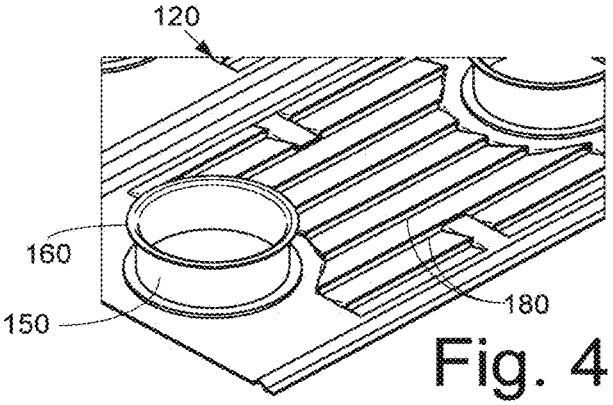
FIG. 4 is a partial, enlarged view of the array of louvered fin plate columns of FIG. 3.
Figure 5:
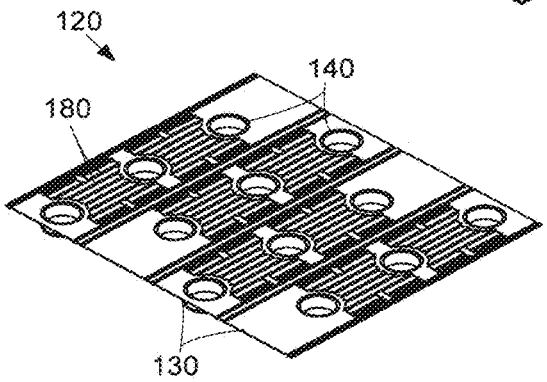
FIG. 5 is a bottom perspective view a portion of the array of louvered fin plate columns of FIG. 2.
Figure 2:
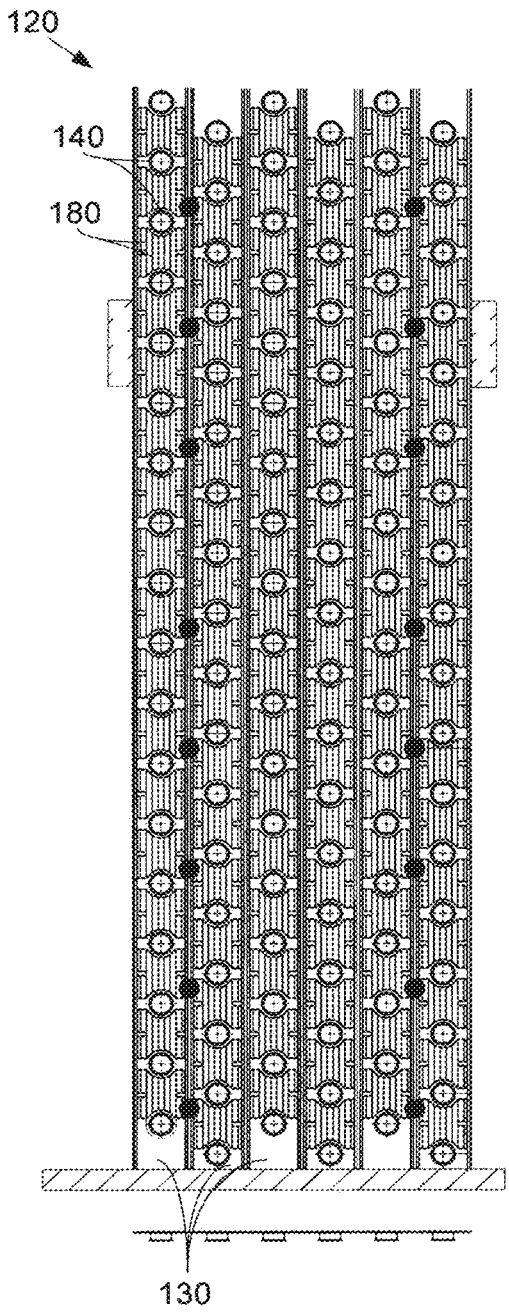
FIG. 2 is a top plan view of an array of louvered fin plate columns for use in the heat exchanger of FIG. 1.

The heat exchanger 100 also may include a number of fin plates 120. Any number of the fin plates 120 may be used herein in any suitable size, shape, configuration, or capacity. The fin plates 120 may be made out of aluminum or any type of metal with good heat transfer characteristics. The fin plates 120 may be arranged in a series of fin plate columns 130. The fin plate columns 130 may have any suitable length or a first dimension. Any number of the fin plate columns 130 may be joined together such that the fin plates 120 as a whole may have any suitable width or a second dimension. For example, six (6) fin plate columns 130 are shown in FIG. 2 while four (4) fin plate columns 130 are shown in FIG. 3 and FIG. 5. Other components and other configurations may be used herein.

Each of the fin plate columns 130 may have a number of tube apertures 140 therein. The tube apertures 140 may have any suitable size, shape, or configuration but are generally sized to accommodate the diameter of the tubes 110 intended to be used therewith. Each tube aperture 140 may be surrounded by a collar 150. The collar 150 may have any suitable height with respect to the fin plate column 130. Specifically, the height of the collar 150 may determine the spacing between the respective tube plates 120. Each collar 150 may have a top mating flange 160 and a bottom mating flange 170. The mating flanges 160, 170 may be sized such that any number of the collars 150 may stacked and nested together as is shown in FIG. 1. Other types of apertures may be used herein. For example, defrost tubes with electric heaters, hot glycol, or other types of heat sources may be used herein. Other components and other configurations may be used herein.

Each fin plate column 130 also may include a number of louvers 180. The louvers 180 may extend between the tube apertures 140 along the length of the fin plate column 130. Although seven (7) louvers 180 are shown herein between the tube apertures 140, any number of the louvers 180 may extend along the width of each fin plate column 130. Each louver 180 may be in the form of an angled plate or slat 190. The angled slat 190 may have any suitable size, shape, or configuration. In this example, the angled slats 190 may have an angle of about ten degrees (10°) to about twenty-five degrees (25°) or so off of the horizontal with about fifteen degrees (15°) or so preferred. Other angles may be used herein. Differing angles also may be used together herein. Each louver 180 may be separated from one another via a louver airflow path 200. The louver airflow path 200 may have any suitable size, shape, or configuration. In this example, the angled slats 190 of the respective louvers 180 may overlap slightly. Other components and other configurations may be used herein.

Each fin plate column 130 may have a number of attachment flanges 210. The attachment flanges 210 may be in the form of a semi-circular boss running along the sides of the each fin plate column 130. Other types of shapes, sizes, and configurations may be used herein. The attachment flanges 210 may be continuous or intermittent. A first side attachment flange 220 of a first fin plate column 130 may attach to a second side attachment flange 230 of a second fin plate column 130. Any number of the fin plate columns 130 may be attached via the attachment flanges 210. Other components and other configurations also may be used herein.

In use, a flow of air 240 flows between each of the fin plates 120 of the heat exchanger 100. The flow of air 240 thus exchanges heat with the first fluid flowing through the tubes 110. The geometry of the louver slats 190 forces the flow of air 240 through the louver airflow paths 200 between the louvers 180. In doing so, any type of airflow boundaries on the louver slates 190 and the fin plates 120 in general may be destroyed or reduced so as to eliminate or reduce overall resistance to heat transfer. The use of the louvers 180 herein thus may increase overall heat exchanger capacity with an increased heat transfer coefficient and less of an airside pressure drop. Moreover, the shape of the louvers 180 described herein do not allow for water stagnation inside of the louver airflow path 200 after a defrost cycle. Specifically, water stagnation may lead to a cycle of water and ice and resultant fin damage. The heat exchanger 100 described herein thus provide increased efficiency, more airflow given less of a pressure drop, and more capacity given the better airflow and heat transfer.

It should be apparent that the foregoing relates only to certain embodiments of the present application and the resultant patent. Numerous changes and modifications may be made herein by one of ordinary skill in the art without departing from the general spirit and scope of the invention as defined by the following claims and the equivalents thereof.

The invention claimed is:

1. A heat exchanger for exchanging heat between a first fluid and a second fluid, comprising:

a plurality of fin plates;

a plurality of louvers disposed on each fin plate of the plurality of fin plates;

wherein each fin plate of the plurality of fin plates includes a pair of attachment flanges;

wherein adjacent fin plates of the plurality of fin plates are attached together via the attachment flanges; and wherein the attachment flanges comprise semi-circular bosses running along sides of each fin plate of the plurality of fin plates.

2. The heat exchanger of claim 1, wherein each louver of the plurality of louvers comprises an angled slat that includes a leading edge that extends above a planar portion of each fin plate of the plurality of fin plates and a trailing edge that extends beneath the planar portion of each fin plate of the plurality of fin plates.

3. The heat exchanger of claim 1, wherein each angled slat comprises an angle of fifteen degrees (15°) off of the horizontal.

4. The heat exchanger of claim 1, wherein the heat exchanger comprises a plurality of fin plate columns.

5. The heat exchanger of claim 1, wherein each fin plate of the plurality of fin plates comprises a plurality of tube apertures.

6. The heat exchanger of claim 5, wherein each aperture of the plurality of tube apertures comprises a collar.

7. The heat exchanger of claim 6, wherein each collar comprises a top mating flange and a bottom mating flange.

8. The heat exchanger of claim 1, wherein the plurality of fin plates are made of aluminum.

9. The heat exchanger of claim 1, further comprising a louver airflow path that passes between adjacent louvers of the plurality of louvers.

10. The heat exchanger of claim 9, wherein the louver airflow path reduces an airflow boundary of the plurality of fin plates.

11. The heat exchanger of claim 1, wherein the second fluid comprises a flow of air.

12. A method of exchanging heat between a first fluid and a second fluid in a fin and tube heat exchanger, comprising:

flowing the first fluid through a plurality of tubes;

flowing the second fluid between a plurality of fin plates, the plurality of tubes extending through the plurality of fin plates, each fin plate of the plurality of fin plates comprising a plurality of louvers;

exchanging heat between the first fluid and the second fluid;

wherein each fin plate of the plurality of fin plates includes a pair of attachment flanges;

wherein adjacent fin plates of the plurality of fin plates are attached together via the attachment flanges; and wherein the attachment flanges comprise semi-circular bosses running along sides of each fin plate of the plurality of fin plates.

13. The method of exchanging heat of claim 12, further comprising:

wherein each louver of the plurality of louvers comprises an angled slat that includes a leading edge that extends above each fin plate of the plurality of fin plates and a trailing edge that extends beneath each fin plate of the plurality of fin plates; and wherein the angled slats reduce a boundary of airflow on the plurality of fin plates.

14. A heat exchanger for exchanging heat between a first fluid and a second fluid, comprising:

a plurality of fin plate columns;

a plurality of tubes extending through the plurality of fin plate columns and configured to flow the first fluid therethrough;

wherein each fin plate of the plurality of fin plate columns comprises a plurality of louvers extending between the plurality of tubes, the plurality of louvers configured to direct a flow of the second fluid through the plurality of louvers;

wherein each fin plate of the plurality of fin plate columns includes a pair of attachment flanges, each attachment flange comprising a semi-circular boss;

wherein adjacent fin plates of the plurality of fin plate columns are attached together via the attachment flanges; and wherein the attachment flanges comprise semi-circular bosses running along sides of each fin plate of the plurality of fin plate columns.

15. The heat exchanger of claim 14, wherein each louver of the plurality of louvers comprises an angled slat that includes a leading edge that extends above a planar portion of each fin plate of the plurality of fin plate columns and a trailing edge that extends beneath the planar portion of each fin plate of the plurality of fin plate columns.

* * * * *